US011529644B2

(12) United States Patent
Bania et al.

(10) Patent No.: US 11,529,644 B2
(45) Date of Patent: Dec. 20, 2022

(54) ROBOTIC APPARATUS FOR PAINTING

(71) Applicant: Fanuc America Corporation, Rochester Hills, MI (US)

(72) Inventors: Andrzej Grzegorz Bania, Warren, MI (US); Michael G. Beem, Lake Orion, MI (US); James Bryon Gerds, II, Rochester Hills, MI (US); Marcin Gora, Shelby Township, MI (US); Stan Henry McClosky, Rochester Hills, MI (US); David Michael Moore, Chesterfield Township, MI (US); Matthew Ray Sikowski, Clarkston, MI (US)

(73) Assignee: FANUC AMERICA CORPORATION, Rochester Hills, MI (US)

( * ) Notice: Subject to any disclaimer, the term of this patent is extended or adjusted under 35 U.S.C. 154(b) by 0 days.

(21) Appl. No.: 16/994,173

(22) Filed: Aug. 14, 2020

(65) Prior Publication Data

US 2020/0376513 A1 Dec. 3, 2020

Related U.S. Application Data

(60) Division of application No. 14/022,301, filed on Sep. 10, 2013, now Pat. No. 9,782,789, and a continuation (Continued)

(51) Int. Cl.
*B05B 16/40* (2018.01)
*B05B 13/04* (2006.01)

(52) U.S. Cl.
CPC ..... *B05B 16/40* (2018.02); *B05B 13/0452* (2013.01); *Y10S 901/43* (2013.01)

(58) Field of Classification Search
USPC ..... 118/323, 321, 326, 309, 634, 50; 427/427.2, 427.3; 700/245, 123; (Continued)

(56) References Cited

U.S. PATENT DOCUMENTS 4,518,307 A 5/1985 Bloch
4,738,015 A 4/1988 Kato
(Continued)

FOREIGN PATENT DOCUMENTS

DE 10010615 A1 9/2001
DE 102008045553 A1 3/2010
(Continued)

*Primary Examiner* — Yewebdar T Tadesse
(74) *Attorney, Agent, or Firm* — John A. Miller; Shumaker, Loop & Kendrick, LLP

(57) ABSTRACT

A robotic apparatus for painting a workpiece includes a redundant axis robot for use in a robotic painting system. The redundant axis of rotation provides the robot arm additional flexibility in avoiding obstacles and reaching an interior of the workpiece to apply paint thereto. The robotic apparatus could be a seven-axis robot arm or a five-axis parallel link panel opener robot arm for opening and/or closing the panel. The robot arms are mounted on at least one vertically oriented column adjacent a path of travel of the workpiece through a painting booth and the robot arms can be mounted on a common base.

20 Claims, 8 Drawing Sheets

Related U.S. Application Data of application No. 15/729,176, filed on Oct. 10, 2017, now abandoned.

(58) Field of Classification Search
USPC .... 414/744.8, 917, 744.1–744.5; 901/43, 15, 901/27, 29, 41
See application file for complete search history.

(56) References Cited

U.S. PATENT DOCUMENTS

| | | | | |
|---|---|---|---|---|
| 5,014,644 | A * | 5/1991 | Yamamoto | B05B 13/0292 118/314 |
| 5,941,679 | A * | 8/1999 | Foti | B25J 15/0019 414/737 |
| 7,650,852 | B2 | 1/2010 | Clifford et al. | |
| 9,782,789 | B2 | 10/2017 | Bania et al. | |
| 2004/0144306 | A1 | 7/2004 | Milojevic et al. | |
| 2005/0166413 | A1 | 8/2005 | Crampton | |
| 2008/0020135 | A1 | 1/2008 | Fouvet | |
| 2009/0320753 | A1 | 12/2009 | Yoshino et al. | |
| 2011/0166708 | A1 | 7/2011 | Herre et al. | |
| 2011/0252913 | A1 | 10/2011 | Ibayashi et al. | |
| 2012/0000312 | A1* | 1/2012 | Collmer | B25J 19/0029 74/490.06 |
| 2012/0325142 | A1 | 12/2012 | Takahashi | |

FOREIGN PATENT DOCUMENTS

| | | | |
|---|---|---|---|
| DE | 102004033640 | B4 | 3/2012 |
| EP | 1970171 | B1 | 6/2009 |
| EP | 2319664 | A1 | 5/2011 |
| EP | 2123365 | B1 | 1/2012 |
| EP | 2497576 | A1 | 9/2012 |
| JP | H01194959 | A | 8/1989 |
| JP | H08173867 | A | 7/1996 |
| JP | H09285747 | | 11/1997 |
| JP | 2002127072 | A | 5/2002 |
| JP | 2007518556 | A | 7/2007 |
| JP | 2011098299 | A | 5/2011 |
| JP | 2011101918 | A | 5/2011 |
| JP | 2011218527 | A | 11/2011 |
| WO | 2008108401 | A1 | 9/2008 |

* cited by examiner

ROBOTIC APPARATUS FOR PAINTING

CROSS-REFERENCE TO RELATED APPLICATIONS

This application is a continuation of U.S. patent application Ser. No. 15/729,176 filed Oct. 10, 2017, which was a divisional of U.S. patent application Ser. No. 14/022,301 filed Sep. 10, 2013 (now issued as U.S. Pat. No. 9,782,789).

Via the aforementioned, this application claims the benefit of U.S. Provisional Application Ser. No. 61/698,952, filed Sep. 10, 2012, the entire disclosure of which is hereby incorporated herein by reference. This application also claims the benefit of U.S. Provisional Application Ser. No. 61/710,096, filed Oct. 5, 2012, the entire disclosure of which is hereby incorporated herein by reference.

FIELD OF THE INVENTION

This invention relates to painting robots and, more particularly, to robots used in a painting booth.

BACKGROUND OF THE INVENTION

Prior art paint booths are well known. A typical prior art paint booth, used to paint the exterior surfaces of vehicle bodies in both continuous conveyance and stop station systems, includes an enclosure housing a plurality of painting and opener robots disposed on a periphery thereof. These robots can be mounted on the floor, the wall or rails. The painting robots carry either spray guns or rotary applicators (bell machines) for directing atomized paint toward the vehicle body.

A newly manufactured automobile body is typically painted with the doors installed. During the painting process, the doors are moved from a closed position to an open position to facilitate the painting of an interior of the automobile body. The doors are returned to the closed position when the painting of the interior of the automobile body is completed. Opener robots featuring a specially adapted tool disposed at the end of an articulated arm are typically employed to grip and move the doors during the opening and closing process. The automobile hood and tailgate/trunk lid can also be installed on the automobile body and must also be opened and closed during the painting process, similar to the doors.

The prior art painting and opener robots are inherently very costly and limit visual access to the booth. For example, prior art floor-mounted robots require significant booth modification when installed in existing paint booths, increasing installation time and cost, and require more booth length and width. Floor-mounted robots also require frequent cleaning due to the down draft of paint overspray causing paint accumulation on the robot arm and base, which results in higher maintenance and cleaning costs. Furthermore, additional robot zones are often required because one painting robot is unable to reach substantially all paintable surfaces on one side of the article and one opener is unable to reach all of the areas to be opened and, therefore, they lack any backup capability for an inoperative robot. If one robot is inoperative, the entire paint booth is inoperative, causing delays and downtime costs.

The prior art floor-mounted robots also lack flexibility. The lack of flexibility is often a result of the prior art floor-mounted robots having robot arms that are segmented to rotate about only six distinct axes of rotation. The end-effector tools disposed at a terminal end of these six axis robots may only be capable of reaching certain positions and orientations within the job envelope using a limited number of configurations of the segments of the robot arm, and in many cases only one configuration allows the end-effector tool to reach a specified position and configuration. These limited configurations may be problematic if a desired position and orientation of the end-effector tool leads to the prior art six axis robots interfering with other robots or components included within the paint booth. To cure this lack of flexibility, many prior art paint booths add an additional degree of freedom to the six axis robots by placing them on a linear rail system. These rail systems may be excessively expensive and space limiting. Prior art rail-mounted robots also require a rail along which the robots can travel to track a moving conveyor. The rail axis of the robot requires doors at each end of the booth. The waist axis of the robot requires additional safety zone(s) at the ends of the spray booth and the rail cabinets of the floor mounted robots encroach into aisle space and add significant cost.

It is desirable, therefore, to provide a painting apparatus and a painting system that utilizes robots in an efficient and cost-effective manner, minimizes paint waste, occupies little space (length and width) in the paint booth, and can be installed in existing paint booths without requiring significant booth modification.

An improvement on the above-described painting systems is disclosed in the U.S. Pat. No. 7,650,852. This patent describes an apparatus for painting objects including an elevated tubular frame rail mounting a four axis robot arm with a paint applicator. The robot is attached to a mounting base that moves along the rail permitting painting of the top and/or side of a vehicle body. Electrical power and fluid lines can be routed through the rail to the robot. Two such rails and multiple robots can be combined as a module for installation in a new or an existing painting booth.

However, there still is a desire to reduce the size of the paint booth even more by eliminating the need for a linear rail system to translate the robots to a desired position and orientation.

SUMMARY OF THE INVENTION

Concordant and consistent with the present invention, a redundant robot in a robotic painting system that substantially reduces the size of the painting booth has surprisingly been discovered. According to the present invention, a redundant axis paint robot enables booth size reduction by increasing the usable envelope of the robot. The redundant axis is used to avoid obstacles, the car body, and the opener robots during operation of the painting robots.

An embodiment of the invention relates to a redundant robot for performing an operation on a workpiece in a painting booth comprising: a base mounted in a fixed position adjacent a side of a path of travel of the workpiece through the painting booth; and an articulated redundant robot arm attached to the base for performing the operation on the workpiece. The base can be mounted on a vertical column positioned adjacent the side of the path of travel. The redundant robot arm can be a seven-axis paint robot arm that includes a redundant axis of rotation positioned between a shoulder axis of rotation and an elbow axis of rotation, wherein a first axis of rotation and the shoulder axis of rotation are perpendicular and intersect. The seven-axis paint robot arm includes an outer arm portion comprising a first outer extension and a second outer extension, wherein a first end of the first outer extension is coupled to an inner arm portion of the seven-axis paint robot arm and a second end of the first outer extension is adjustably coupled to a first end of the second outer extension for selectively adjusting an angular orientation between the first and second outer extensions and fixing the selected angular orientation as a static connection therebetween. The adjustable connection between the first outer extension and the second outer extension permits a longitudinal axis of the second outer extension to be offset from a longitudinal axis of the inner arm portion. An inner arm portion of the seven-axis paint robot arm can have an angled longitudinal axis. The seven-axis paint robot arm can include a painting line hose loom having a portion spanning two axes of the seven-axis paint robot arm that is detached from the seven-axis paint robot arm, the two axes being a waist axis and a shoulder axis or a redundant axis and an elbow axis. The hose loom can have a portion routed through an interior of the seven-axis paint robot arm between the shoulder axis and the redundant axis and can be formed of a plurality of paint lines routed together in a helix twist.

The redundant robot arm can be a five-axis opener robot arm that includes three parallel links rotatably connected and an attached opener tool for opening at least one opening panel of the workpiece. The three parallel links are offset from one another in a direction of an axis of rotation of the links. The redundant robot can include a common base for mounting one or more robot arms or opening devices.

In one embodiment, a robotic painting system for painting a vehicle body having opening door, hood, and deck panels comprises a plurality of vertical columns positioned on opposite sides of a path of travel of a vehicle body through a painting booth. The system further includes a first pair of six or seven axis paint robot arms attached to a first pair of the columns for painting a first exterior coat on the vehicle body; four seven axis paint robot arms each attached to one of four of the columns for painting an interior of the vehicle body; and a second pair of six or seven axis paint robot arms attached to a second pair of the columns for painting a second exterior coat on the vehicle body.

DESCRIPTION OF THE DRAWINGS

The above as well as other advantages of the present invention will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
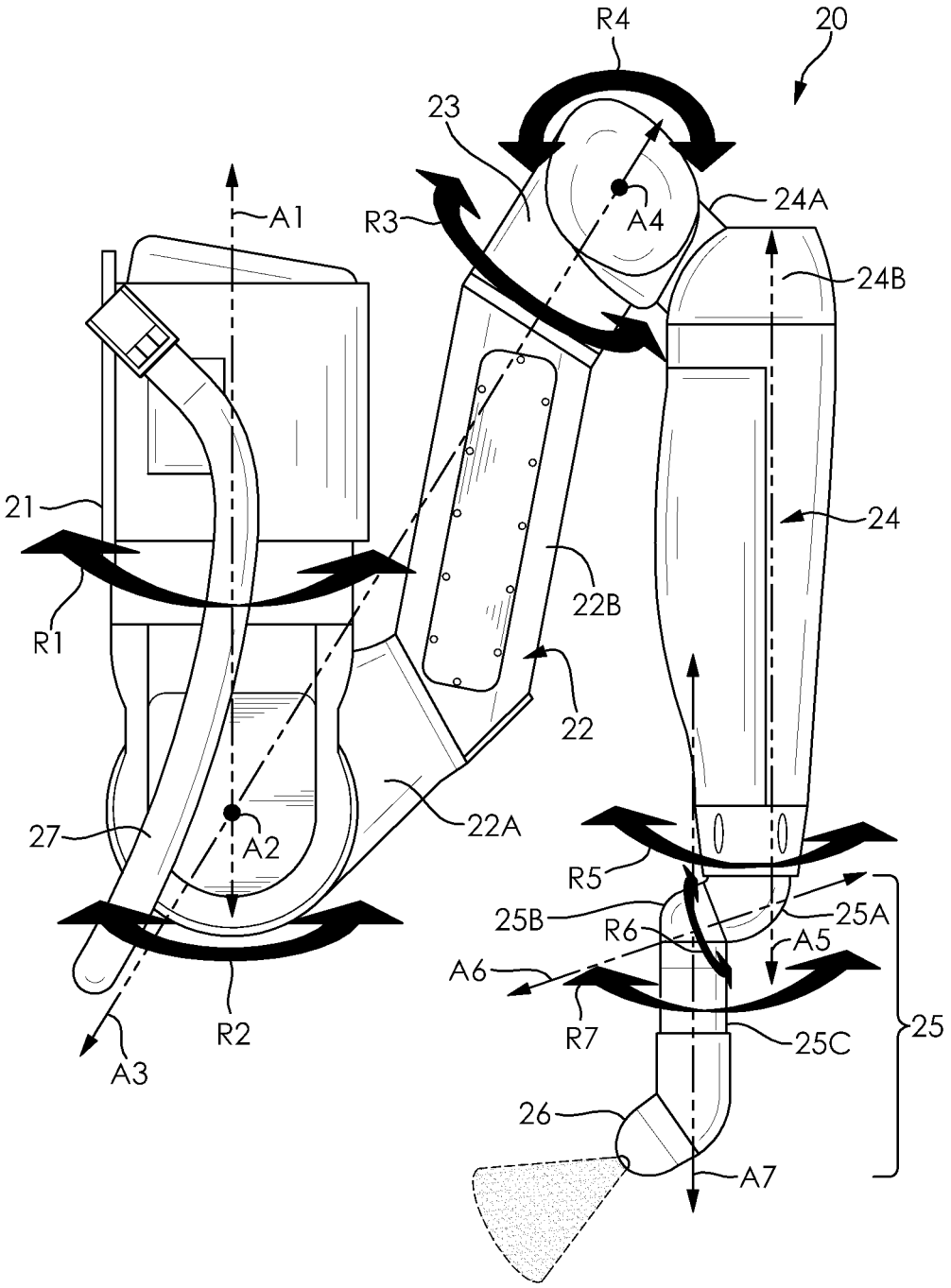
FIG. 1 is an elevation view of a redundant axis paint robot according to the invention.

FIG. 1 is an elevation view of a seven-axis paint robot 20 according to the invention. The seven-axis paint robot 20 includes a redundant axis of rotation that enables booth size reduction by increasing the usable envelope of the robot without use of a rail system. The redundant axis allows the seven-axis paint robot 20 to avoid obstacles in a paint booth, such as a workpiece and panel opener devices when the seven-axis paint robot 20 is actuated to desired positions and orientations. Similarly, the redundant axis allows the use of the five-axis door and hood-deck openers without a rail.

The seven-axis paint robot 20 is a seven-axis articulated robot arm mounted on a modular base 21 that is adaptable to various mounting positions, such as wall-mounting, or overhead mounting, for instance. In FIG. 1, the modular base 21 is oriented for attachment to a vertical surface (not shown) such as a paint booth wall or a vertical post or column used in a paint booth. The mounting configuration of the seven-axis paint robot 20 shown in FIG. 1 is considered to be an invert mounting configuration because the seven-axis paint robot 20 extends downwardly from the modular base 21.

As shown in FIG. 1, the seven-axis paint robot 20 is rotatably coupled to the modular base 21 for rotation of the seven-axis paint robot 20 about a first axis of rotation A1, also referred to as a "waist" axis of rotation. The first axis of rotation A1 is shown to be a vertically aligned axis of rotation, allowing the robot arm 20 to rotate in a horizontally aligned plane in a first direction of rotation R1. A second axis of rotation A2, also referred to as a "shoulder" axis of rotation, is perpendicular with, intersects, and extends traverse to the first axis of rotation A1, permitting rotational movement of the robot arm 20 along a vertical plane in a second direction of rotation R2, as shown in FIG. 1. It should be understood that different mounting configurations will result in the first and second axes of rotation A1, A2 having different spatial orientations than those shown in FIG. 1.

A first or inner arm portion 22 of the seven-axis paint robot 20 is rotatably coupled at a first end thereof to the modular base 21 for rotation about the second axis of rotation A2. The inner arm portion 22 is of a generally curved or angled two-part construction to provide left hand and right hand configurations and optimized reach of the seven-axis paint robot 20. As shown in FIG. 1, the inner arm portion 22 includes a first inner extension 22A and a second inner extension 22B. A first end of the first inner extension 22A is rotatably coupled to the modular base 21 at the second axis of rotation A2 while a second end of the first inner extension 22A is statically secured to a first end of the second inner extension 22B. A longitudinal axis of the second inner extension 22B is angled with respect to a longitudinal axis of the first inner extension 22A, creating an offset of the second inner extension 22B relative to the modular base 21. The offset between the second inner extension 22B and the modular base 21 allows for the inner arm portion 22 to cover a wider range or rotation about the modular base 21 without the inner arm portion 22 interfering or colliding with the modular base 21.

A second end of the second inner extension 22B is rotatably coupled about a third axis of rotation A3 to a first end of an elbow component 23, allowing for rotation in a third direction of rotation R3. As shown in FIG. 1, the third axis of rotation A3 intersects both the first axis of rotation A1 and the second axis of rotation A2 at the rotatable connection formed between the inner arm portion 22 and the modular base 21. The elbow component 23 connects the inner arm portion 22 to a second or outer arm portion 24. The elbow component 23 forms a rotatable connection between the inner arm portion 22 and the outer arm portion 24 about a fourth axis of rotation A4, also known as an "elbow" axis of rotation, allowing for rotation in a fourth direction of rotation R4. The third axis of rotation A3 formed between the elbow component 23 and the second inner extension 22B of the inner arm portion 22 is aligned transverse to and intersects the fourth axis of rotation A4.

The outer arm portion 24 is mounted at a first end thereof to a second end of the elbow component 23 for rotation about the fourth axis of rotation A4. The outer arm portion 24 is modular and includes a first outer extension 24A and a second outer extension 24B. A first end of the first outer extension 24A is rotatably coupled to a second end of the elbow component 23 at the fourth axis of rotation A4 while a second end of the first outer extension 24A is adjustably connected to a first end of the second outer extension 24B. The adjustable connection formed between the first outer extension 24A and the second outer extension 24B allows for a longitudinal axis of the second outer extension 24B to be selectively adjusted to various angular orientations with respect to a longitudinal axis of the first outer extension 24A. It should be understood that once the adjustable connection is formed between the first and second outer extensions 24A, 24B, the connection is fixed to form a static connection and the first and second extensions 24A, 24B are caused to move in unison during manipulation of the seven-axis paint robot 20. For example, the extensions 24A and 24B can be rotatably coupled for selective adjustment of the angle and be provided with an annular array of holes for accepting fastening means to fix the selected angle.

Figure 2A:
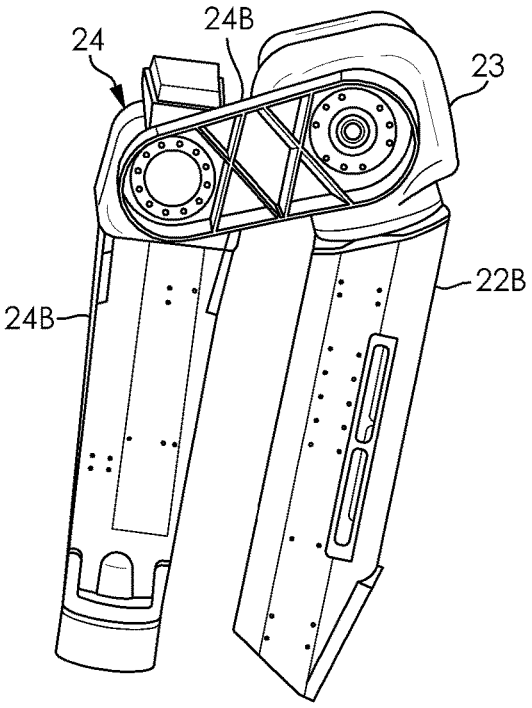
FIG. 2A is an elevation view of a left-hand configuration of the redundant axis paint robot of FIG. 1.
Figure 2B:
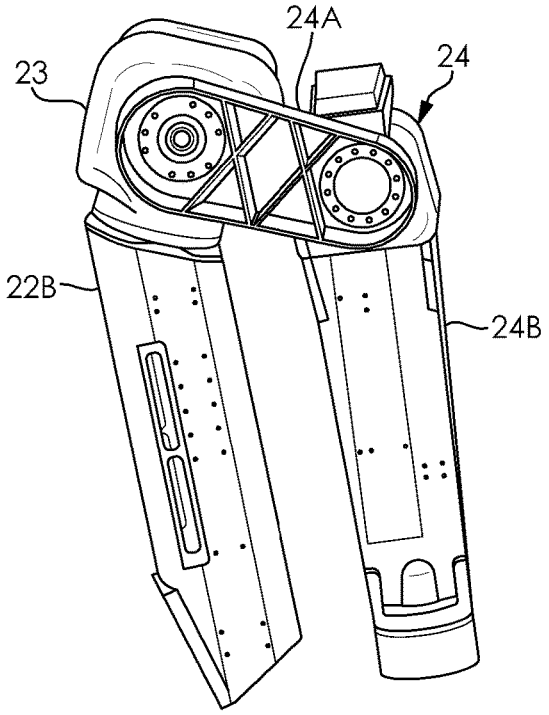
FIG. 2B is an elevation view of a right-hand configuration of the redundant axis paint robot of FIG. 1.
Figure 3A:
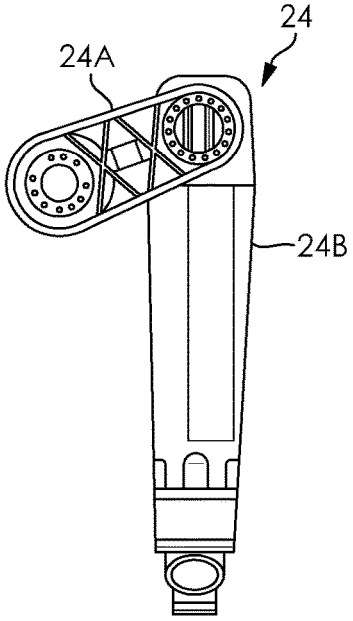
FIG. 3A is an elevation view of an outer arm portion of the paint robot of FIG. 1 having a first adjustable configuration.
Figure 3C:
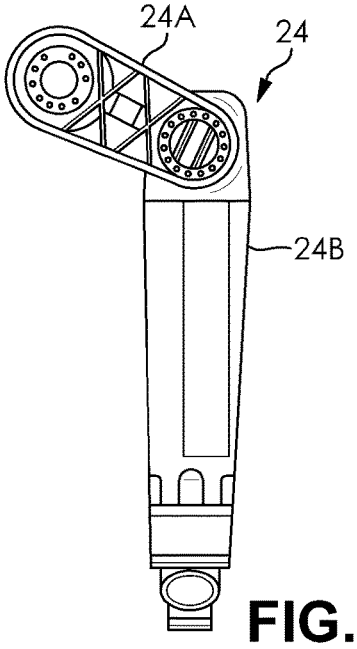
FIG. 3C is an elevation view of an outer arm portion of the paint robot of FIG. 1 having a third adjustable configuration.
Figure 3B:
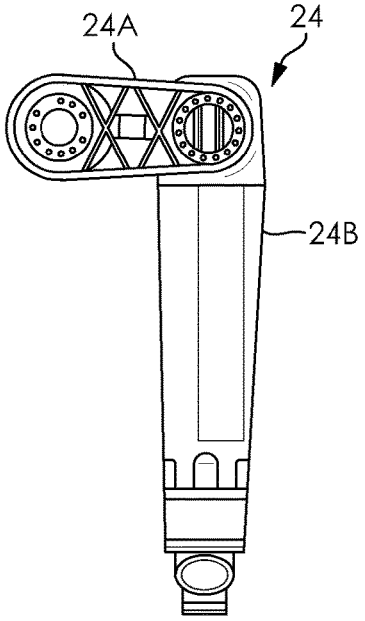
FIG. 3B is an elevation view of an outer arm portion of the paint robot of FIG. 1 having a second adjustable configuration.

The adjustable connection allows the second outer extension 24B to be attached or clocked in many different configurations relative to the first outer extension 24A to allow for left hand and right hand configurations (as shown in FIGS. 2A and 2B respectively) and different kinematic configurations and arm sizes (as shown in FIGS. 3A, 3B, and 3C). The first outer extension 24A forms an offset of the second outer extension 24B relative to the elbow component 23 and the inner arm portion 22, improving the "near reach" capabilities of the outer arm portion 24. The "near reach" capability of the outer arm portion 24 refers to the ability of the outer arm portion 24 to access areas of the job envelope of the seven-axis paint robot 20 located adjacent the modular base 21. As explained above and shown in FIGS. 3A, 3B, and 3C, an operator of the seven-axis paint robot 20 may select the position of the first outer extension 24A relative to the second outer extension 24B to alter a total length of the seven-axis paint robot 20, a range of motion of the outer arm portion 24 relative to the inner arm portion 22, and an offset of the second outer extension 24B relative to the inner arm portion 22. This adjustability of the outer arm portion 24 aids the operator in configuring the seven-axis paint robot 20 for tasks that may require variable arm lengths or orientations to either reach specified portions of a job article or to avoid obstacles (including components of the seven-axis paint robot 20 itself) that may be encountered by the seven-axis paint robot 20 while trying to accomplish the specified task.

A wrist component 25 is rotatably coupled to a second end of the fourth extension 24B of the outer arm portion 24 at a fifth axis of rotation A5, allowing for rotation in a fifth direction of rotation R5. The fifth axis of rotation A5 is aligned parallel to a longitudinal axis of the fourth extension 24B of the outer arm portion 24. The wrist component 25 is comprised of a first wrist segment 25A, a second wrist segment 25B, and a third wrist segment 25C. A first end of the first wrist segment 25A is rotatably coupled to the second end of the fourth extension 24B for rotation about the fifth axis of rotation A5 while a second end of the first wrist segment 25A is rotatably coupled to a first end of the second wrist segment 25B for rotation in a sixth direction of rotation R6 about a sixth axis of rotation A6. The sixth axis of rotation A6 is angled relative to the fifth axis of rotation A5, causing the second wrist segment 25B and the third wrist segment 25C to tilt relative to the fourth extension 24B of the outer arm portion 24 during rotation of the second wrist segment 25B about the sixth axis of rotation A6. For this reason, the sixth axis of rotation A6 may be referred to as a "tilt" axis of rotation.

A second end of the second wrist segment 25B is rotatably coupled to a first end of the third wrist segment 25C about a seventh axis of rotation A7, allowing for rotation in a seventh direction of rotation R7. The seventh axis of rotation A7 is aligned to be angled relative to the sixth axis of rotation A6 and parallel to and offset from the fifth axis of rotation A5. A paint applicator 26 is attached to a second end of the third wrist segment 25C. It should be understood that the paint applicator may be any type of suitable paint applicator, including a circular spray pattern bell applicator or a traditional spray gun, for instance. It should also be understood that in place of a paint applicator 26, any number of components may be attached to the second end of the third wrist segment 25C, such as a welding tool, a gripping tool, a fastening tool, etc., depending on the desired application of the seven-axis paint robot 20. Accordingly, it should also be understood that the paint applicator 26 or any other end-effector robotic tool may be removably attached to the third wrist segment 25C to accommodate the different possible tasks performed by the seven-axis paint robot 20.

As described hereinabove, the seven-axis paint robot 20 is provided with seven distinct axes of rotation A1, A2, A3, A4, A5, A6, A7 for rotation in seven directions of rotation R1, R2, R3, R4, R5, R6, R7. Because the seven-axis paint robot 20 only requires six axes of rotation for the paint applicator 26 disposed at a distal end of the seven-axis paint robot 20 to reach a desired position and orientation within the job envelop of the seven-axis paint robot 20, the addition of a seventh axis of rotation causes the seven-axis paint robot 20 to have a redundant axis of rotation. The seven-axis robot arm 20 differs from traditional six-axis robots due to the addition of the third axis of rotation A3 between the second axis of rotation A2 (the shoulder axis of rotation) and the fourth axis of rotation A4 (the elbow axis of rotation). Accordingly, the third axis of rotation A3 is considered a redundant axis of rotation.

Robotic systems having a redundant axis of rotation are capable of changing the configuration of the robot arm components between the origin of the robot arm and the end-effector tool of the robot arm without changing the position and orientation of the end-effector tool of the robot arm. Accordingly, the addition of a redundant axis of rotation (the third axis of rotation A3) allows for variable positioning of the inner arm portion 22, the elbow component 23, the outer arm portion 24, and the wrist component 25 while the paint applicator 26 remains in a fixed position and orientation. The ability of the components 22, 23, 24, 25 of the seven-axis paint robot 20 to be positioned and oriented in multiple alternate configurations allows for the seven-axis paint robot 20 to be configured to avoid obstacles and reach portions of a workpiece that may not be possible with a traditional stationary six-axis robot. This flexibility in turn allows the seven-axis paint robot 20 to be installed in a manner that mitigates against space constraints and the need for multiple six-axis robots to achieve a particular task.

Figure 4A:
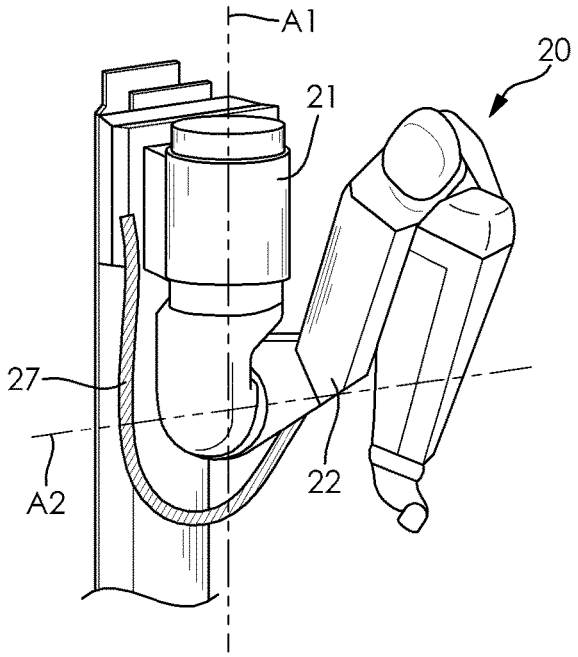
FIG. 4A is a perspective view of the paint robot of FIG. 1 showing a hose loom spanning a waist axis and a shoulder axis of the paint robot.
Figure 4B:
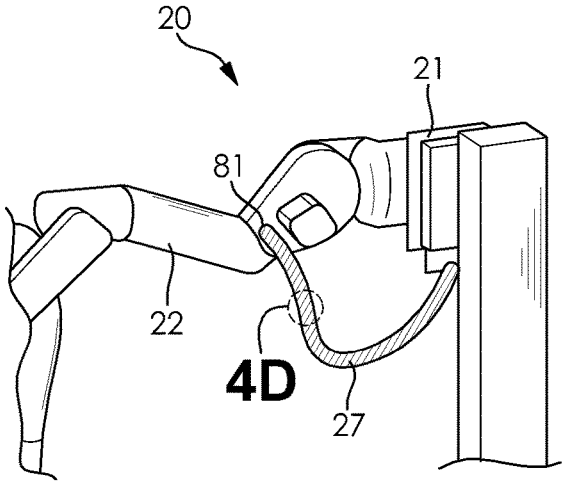
FIG. 4B is a perspective view of the paint robot of FIG. 1 showing a first attachment point and a second attachment point of the hose loom of FIG. 4A.
Figure 4C:
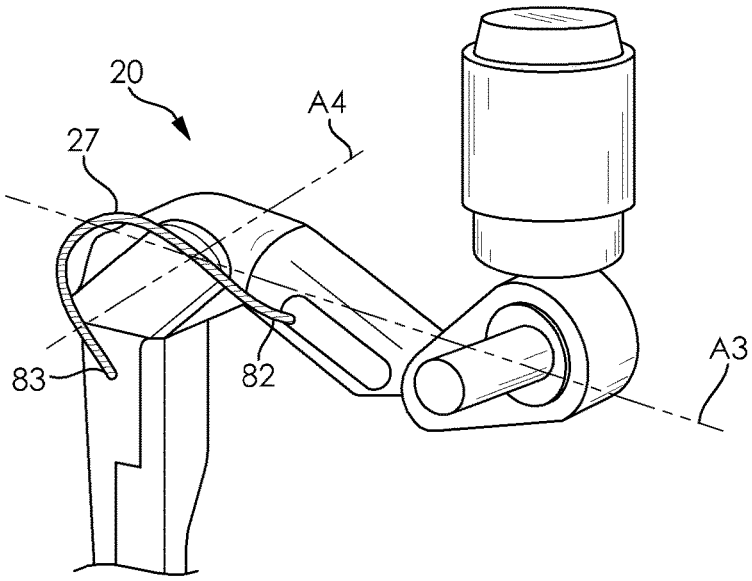
FIG. 4C is a perspective view of the paint robot of FIG. 1 showing a third attachment point and a fourth attachment point of the hose loom of FIG. 4A.
Figure 4D:
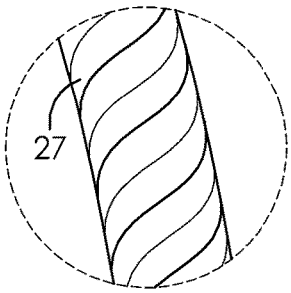
FIG. 4D is an enlarged perspective view of a portion of the hose loom of FIG. 4A showing the hose loom having a helix twist arrangement.

FIGS. 4A-4D show a method for paint line routing to achieve a booth size reduction. A plurality of paint lines are routed together with a helix twist to form a hose loom 27, as shown in FIG. 4D. The twisting of the paint lines forming the hose loom 27 keeps the paint lines grouped together during movement of the seven-axis paint robot 20. The hose loom 27 is attached to the seven-axis paint robot 20 at selected locations to allow the seven-axis paint robot 20 to maintain its full range of motion. The hose loom 27 is typically mounted to and originates from a vertically arranged surface adjacent the modular base 21 such as a wall of the paint booth or a column. It should be understood, however, that the hose loom 27 may originate from the modular base 21 or any other component included within the paint booth, as desired. As shown in FIG. 4B, a first attachment point 81 of the hose loom 27 to the seven-axis paint robot 20 is located on the inner arm portion 22 of the seven-axis paint robot 20. The location of the first attachment point 81 allows for the hose loom 27 to be detached from both the robot arm 20 and the vertically arranged surface from which the hose loom 27 originates to span across two axes of rotation of the seven-axis paint robot 20, the first axis of rotation A1 and the second axis of rotation A2.

Once the hose loom 27 meets the seven-axis paint robot 20 at the first attachment point 81, the hose loom 27 may be routed through an interior of the inner arm portion 22 until it emerges at a second attachment point 82, as shown in FIG. 4C. The hose loom 27 then extends away from the second attachment point 82 to again be freely detached from the seven-axis paint robot 20 to span two additional axes of rotation, the third axis of rotation A3 and the fourth axis of rotation A4. The hose loom 27 is then attached to the seven-axis paint robot 20 again at a third attachment point 83 located on the outer arm portion 24. Once attached to the outer arm portion 24 at the third attachment point 83, the hose loom 27 may then be routed through an interior of the outer arm portion 24 toward the wrist component 25. The wrist component 25 is configured such that the hose loom 27 may be routed through an interior of the first, second, and third wrist segments 25A, 25B, 25C, allowing the hose loom 27 to be routed within an interior of the seven-axis paint robot 20 while spanning the fifth, sixth, and seventh axes of rotation A5, A6, A7. The hose loom 27 then terminates at the paint applicator 26.

The method for reducing paint booth size according to the invention includes one or more of the features described below. As a system, a plurality of robots paints a workpiece such as a vehicle body. For example, this painting process can be performed with a first exterior coat, then an interior coat, and then a second exterior coat. During the interior processing, the first exterior coat has time to flash. The paint robots include the seven-axis paint robots 20 that are invert mounted for the interior painting process. Six or seven-axis wall mount robots are used for the exterior painting. Door and hood-deck openers are used to assist the paint robots in reaching interior portions of a vehicle being painted.

Figure 5:
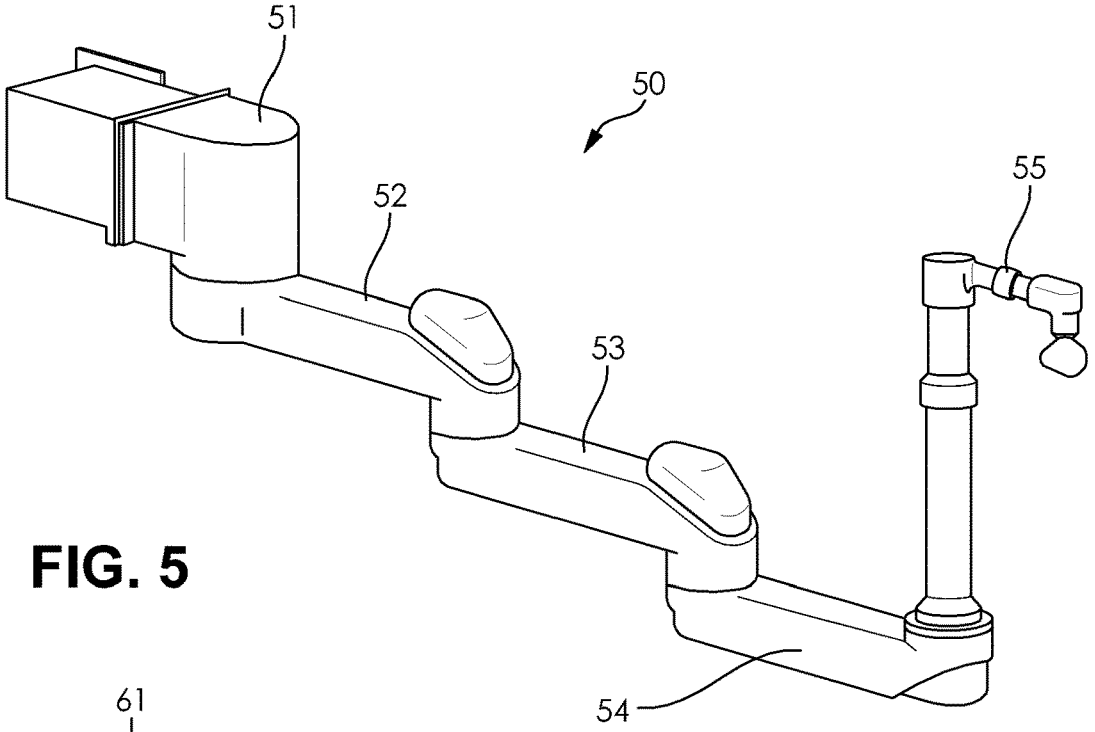
FIG. 5 is a perspective view of a door opener robot according to the invention.

FIG. 5 is a perspective view of a door opener robot 50 according to the invention. The door opener robot 50 is a three parallel-link robot arm used for opening a door panel of a vehicle to allow for access to an interior of the vehicle body to apply paint thereto. The door opener robot arm has a base 51 for attachment to a vertical surface such as a wall of the paint booth or a vertically arranged column. An inner link 52 has a first end rotatably coupled to the base 51 for rotation about a first vertical axis of rotation. This first vertical rotary axis replaces the rail in the prior art. A second end of the inner link 52 is rotatably coupled to a first end of a middle link 53 for rotation about a second vertical axis of rotation. A second end of the middle link 53 is rotatably coupled to a first end of an outer link 54 for rotation about a third vertical axis of rotation. As shown in FIG. 5, the middle link 53 is vertically offset below the inner link 52 while the outer link 54 is vertically offset below the middle link 53. It should be understood, however, that any configuration of offsets between the links 52, 53, 54 may be utilized to better configure the hood-deck opener robot 50 to avoid obstacles and in turn potentially reduce the size of a paint booth. A second end of the outer link 54 is coupled to a door opener tool 55 used to reach through a door window of a vehicle 31 (FIG. 7B) to open the door for the application of paint to an interior of the vehicle 31. The door opener tool 55 further includes a fourth axis of rotation and a fifth axis of rotation, causing the door opener robot 50 to be a 5-axis robot.

Figure 6:
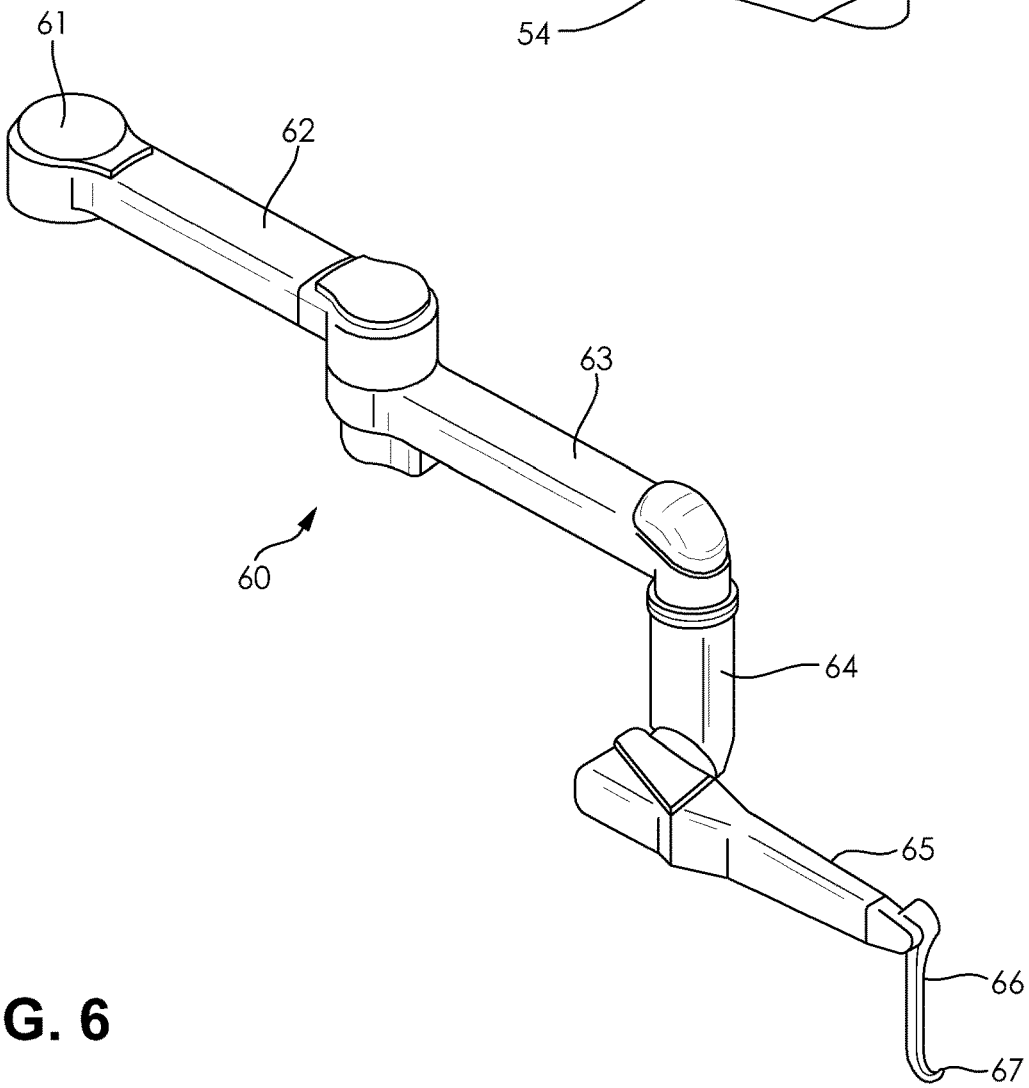
FIG. 6 is a perspective view of a hood-deck opener robot according to the invention.

FIG. 6 is a perspective view of a hood-deck opener robot 60 according to the invention. The hood-deck opener robot 60 is generally a three parallel-link robot arm used to open one of a hood, deck, or trunk compartment of a vehicle body to allow for access to an interior of the vehicle body to apply paint thereto. The hood-deck opener robot 60 has a base 61 for attachment to a vertically arranged surface such as a wall of a paint booth or a vertically arranged column. A first link 62 has a first end rotatably coupled to the base 61 for rotation about a first vertical axis of rotation. This first rotary axis replaces the rail in the prior art. A second end of the first link 62 is rotatably coupled to a first end of a second link 63 for rotation about a second vertical axis of rotation. A second end of the second link 63 is attached to a first end of a third link 64 for rotation about a third vertical axis of rotation. The third link 64 extends vertically downward in a direction parallel to the third vertical axis of rotation. A second end of the third link 64 is rotatably coupled to a first end of a fourth link 65 about a fourth axis of rotation, the fourth axis of rotation being aligned transverse to the third vertical axis of rotation. A second end of the fourth link 65 is rotatably coupled to a hood-deck opener tool 66 about a fifth axis of rotation, the fifth axis of rotation being parallel to and offset from the fourth axis of rotation. The hood-deck opener tool 66 includes a hook 67 disposed at a distal end thereof. The hood-deck opener tool 66 is used to open a hood or a trunk compartment of a vehicle.

Figure 7A:
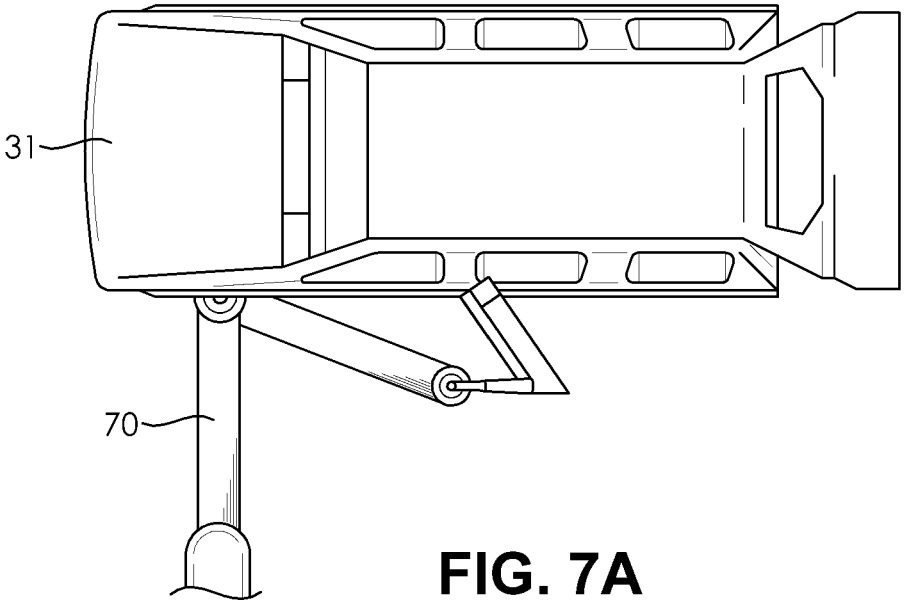
FIG. 7A PRIOR ART
FIG. 7A is a plan view showing an interference condition of a prior art 3-link robot arm with a vehicle.
Figure 7B:
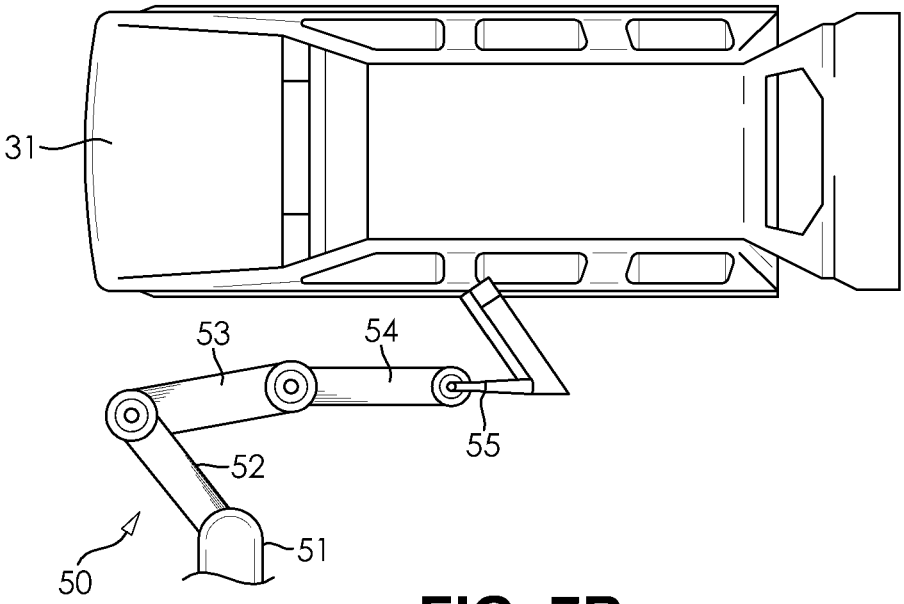
FIG. 7B is a plan view showing the door opener robot of FIG. 5 avoiding an interference condition with a vehicle.

As shown in FIGS. 5 and 6, the door opener robot 50 and the hood-deck opener robot 60 each utilize three distinct vertically oriented axes of rotation to translate the end-effecting tools 55, 66 of the opener robots 50, 60 to a desired position along a horizontally aligned plane. This means that each of the opener robots 50, 60 has three degrees of freedom to translate the end-effecting tools 55, 66 along two planar translational dimensions. Accordingly, each of the door opener robot 50 and the hood-deck opener robot 60 includes a redundant axis of rotation. This redundancy allows for the avoidance of obstacles without the expensive, cumbersome rail of the prior art paint booths. The door opener robot 50 may have a reach equivalent to a conventional two-link door opener robot arm 70 (FIG. 7A) having two vertically oriented axes of rotation when opening a door of the vehicle body 31. As shown in FIG. 7B, the door opener robot arm 50 also avoids an interference condition with a vehicle body 31 that is common when utilizing the two-link door opener robot arm 70 as shown in FIG. 7A. In addition, the elimination of the rail allows greater flexibility as to where the opener arms 50, 60 are placed, including on a column or on a common modular base 21, and elevated above, below or next to the other robots included in the paint booth. It should be understood that all of these same abilities apply to the hood-deck opener robot 60 in addition to the door opener robot 50.

Figure 8A:
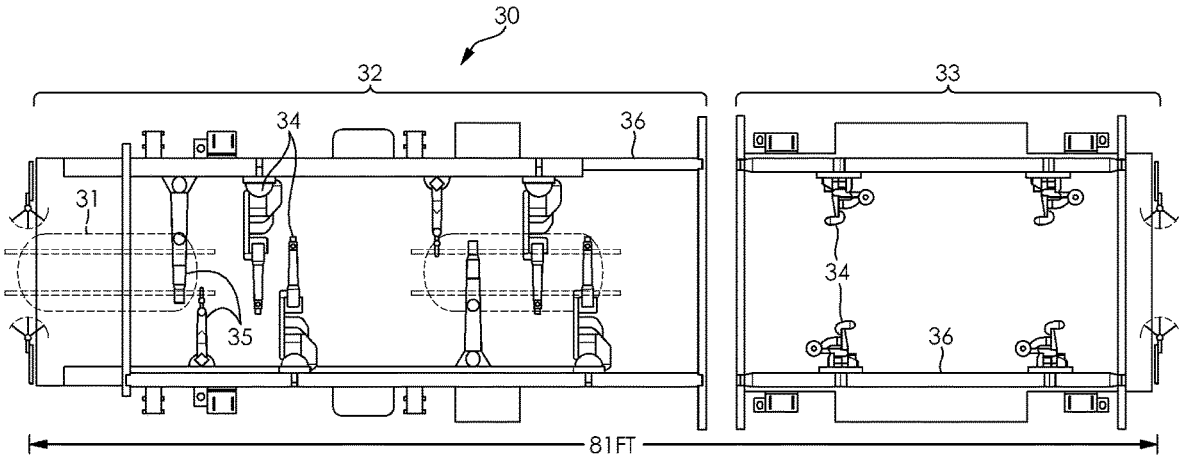
FIG. 8A PRIOR ART
FIG. 8A is a plan view of a prior art paint booth utilizing a rail system.
Figure 8B:
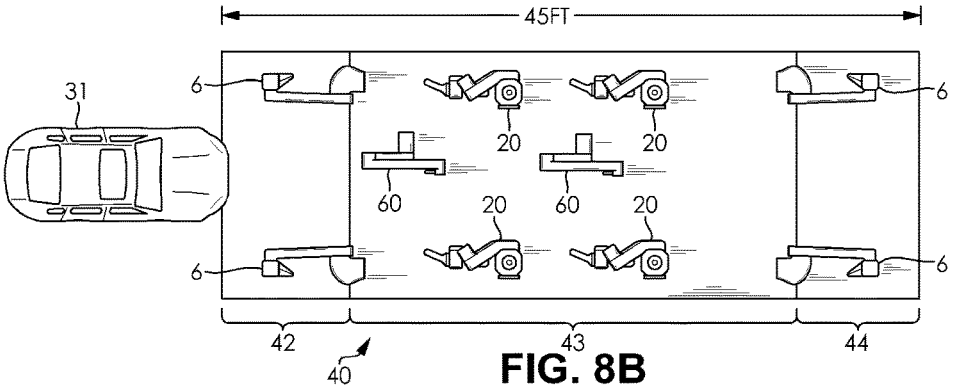
FIG. 8B is a plan view of a paint booth according to invention showing a size reduction compared to the prior art paint booth of FIG. 8A.

FIG. 8A is a top plan view of a typical prior art paint booth 30 utilizing a rail system while FIG. 8B is a top plan view showing a 44% length reduction, for example, of a paint booth 40 according to the invention. The typical prior art paint booth 30 has a length of approximately eighty-one feet. The vehicle body 31 enters at the left end of the booth 30 and receives a first coat of paint on the exterior and the interior from a plurality of six and seven axis paint robots 34 in cooperation with a plurality of door and hood-deck openers 35 all mounted on rails 36 in a first section 32 of the booth. The vehicle body 31 receives a second coat of paint on the exterior from another plurality of paint robots 34 mounted on rails 36 in a second section 33 at the right end of the booth 30. It should be understood that the mounting of the various types of robots on a translatable rail adds an additional axis along which the robots may move, adding an additional degree of freedom to each robot. However, the addition of the rail system may result in a lengthening of the paint booth 30. This occurs because in many instances one of the robots translatable along the rail system may need to be translated to various positions along the rail to reach portions of the vehicle body. Alternatively, the robot may have to be translated to a desired position along the rail for the end-effecting tool disposed at a distal end of the robot arm to have a desired position and orientation without the remainder of the robot interfering with the vehicle body 31 or other components of the paint booth 30. In either instance, the addition of the rail system may lead to a greater length of the paint booth 30 being associated with each robot translatable along the rail system, causing the overall length of the paint booth 30 to increase.

The reduced length booth 40 according to the invention has a length of approximately forty-five feet, as shown in FIG. 8B. The vehicle body 31 enters at the left end of the booth 40 and receives a first coat of paint on the exterior in a first section 42 at a left or entrance end the booth from a pair of six axis paint robots 6. The six axis paint robots 6 are similar to the seven-axis paint robots 20 described hereinabove except for the exclusion of the redundant third axis of rotation A3. The six-axis paint robots 6 are able to be used rather than the seven-axis paint robots 20 because the doors, hood, and trunk of the vehicle body 31 have not yet been opened, eliminating a potential obstacle for the six-axis paint robots 6 to avoid that otherwise could only be avoided by the additional flexibility of the seven-axis paint robots 20. It should be understood, however, that the seven-axis paint robots 20 may be used in place of the six-axis paint robots 6 for certain applications requiring additional flexibility to avoid obstacles, as desired.

The body 31 then moves to a second or intermediate section 43 of the booth 40 to receive an interior coat of paint from a plurality of the seven-axis paint robots 20 that are invert mounted and assisted by a plurality of the hood-deck opener robots 60 and the door opener robots 50 (not shown in FIG. 8B). The seven-axis paint robots 20 are preferable for painting the interior coat of the vehicle body 31 because the seven-axis paint robots 20 allow for greater flexibility in reaching through the openings formed by the opened doors, hood, and trunk lid while avoiding the other robots 6, 20, 50, 60, portions of the vehicle body 31, and any other components of the paint booth 40. The vehicle body 31 receives a second coat of paint on the exterior from another plurality of six-axis paint robots 6 in a third or exit section 44 at the right end of the booth 40. Again, it should be understood that the seven-axis paint robots 20 may be used in place of the six-axis paint robots 6, as desired.

Figure 9:
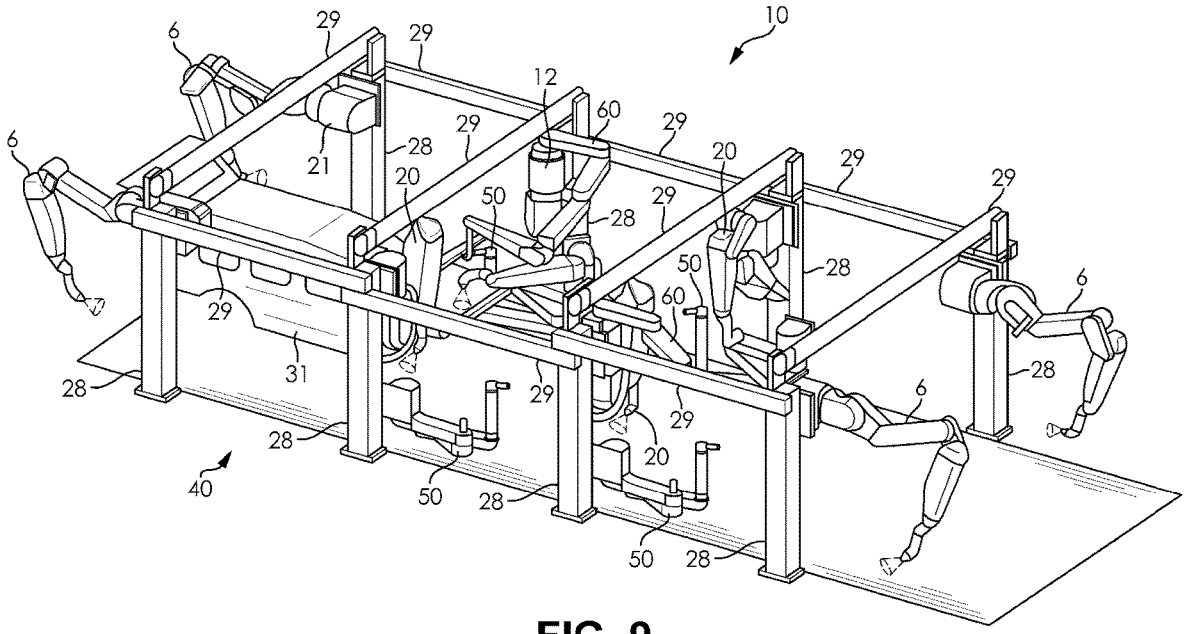
FIG. 9 is a perspective view of a different configuration of the paint booth of FIG. 8B.

FIG. 9 is a perspective view of a paint robot system 10 according to the invention for use in the paint booth 40 shown in FIG. 8B. A plurality of vertical columns 28 (eight columns are shown) are connected at upper ends thereof by horizontal beams 29 to form a robot supporting structure. As shown in FIG. 9, the paint robot system 10 includes four of the vertically oriented columns 28 on each longitudinal side of the paint booth 40 adjacent a path of travel of the vehicle 31 as it passes through the paint booth 40. The columns 28 aligned on each longitudinal side of the paint booth 40 are generally arranged along a straight line parallel to the path of movement of the vehicle body 31. Each of four columns 28 on each longitudinal side of the paint booth 40 is connected to at least one adjacent column 28 in a longitudinal direction of the paint booth 40 by one of the horizontal beams 29. Each column 28 on one longitudinal side of the paint booth 40 has a corresponding or opposed column 28 on a second longitudinal side of the paint booth 40 to form four pairs of the columns 28, and each pair of the columns 28 is interconnected by one of the horizontal beams 29. The columns 28 have a height such that the horizontal beams 29 connecting the upper ends of the columns 28 are arranged to be above an upper plane of the vehicle body 31 as it passes down the path formed between the longitudinal rows of the columns 28. It should be understood that the vertical columns 28 and the horizontal beams 29 may be tubular with hollow interiors in order to route wiring or supply lines to the robots 6, 20, 50, 60 without interfering with the remainder of the paint robot system 10.

A first section of the painting booth 40 formed at an entrance (left end) of the painting booth 40 includes a first pair of the columns 28. Two six-axis exterior paint robots 6 are each mounted on an associated one of the columns 28 located in the first section for painting the first exterior coat to be applied to the vehicle body 31. A third section of the painting booth 40 formed at an exit (right end) of the painting booth 40 includes a second pair of the columns 28. Two more of the six-axis exterior paint robots 6 are mounted on associated ones of the columns 28 located in the third section for painting the second exterior coat. The seven-axis paint robots 20 can be used for the exterior painting in the first and third sections of the painting booth 40 in place of the six-axis paint robots 6 as well, as desired. As shown in FIG. 9, the six-axis paint robots 6 are mounted to the columns 28 such that a waist axis of rotation of each of the six-axis paint robots 6 is oriented horizontally parallel to the longitudinal axis of the booth 40.

A second section of the painting booth 40 is formed in a central portion of the painting booth 40 between the entrance and the exit thereof. The second section of the painting booth includes four of the columns 28, forming two pairs of the columns 28. In the second section of the painting booth 40, each of the four columns 28 has mounted thereon one of the seven-axis interior paint robots 20 and a five-axis door opener robot 50. The five-axis door opener robots 50 are mounted to the columns 28 below the invert mounted seven-axis paint robots 20 to prevent interference between the seven-axis paint robot 20 and the five-axis door opener robot 50. Furthermore, as shown in FIG. 9, the use of the three vertically oriented axes of rotation connecting the links 52, 53, 54 of the door opener robot 50 allows for each of the door opener robots 50 to be retracted toward each of the associated columns 28 when not in use to further prevent interference between the seven-axis paint robots 20 and the five-axis door opener robots 50. One of the columns 28 at the right end of the central portion of the system 10 and one of the columns 28 at the left end of the central portion each have a five-axis hood-deck opener robot arm 60 mounted thereon. The system 10 eliminates the rails 36 used in the prior art paint booth 30 shown in FIG. 8A since all of the robots 6, 20, 50, 60 are mounted on the columns 28 such that each robot 6, 20, 50, 60 is mounted to a stationary base, thereby reducing the length of the paint booth 40.

Figure 10:
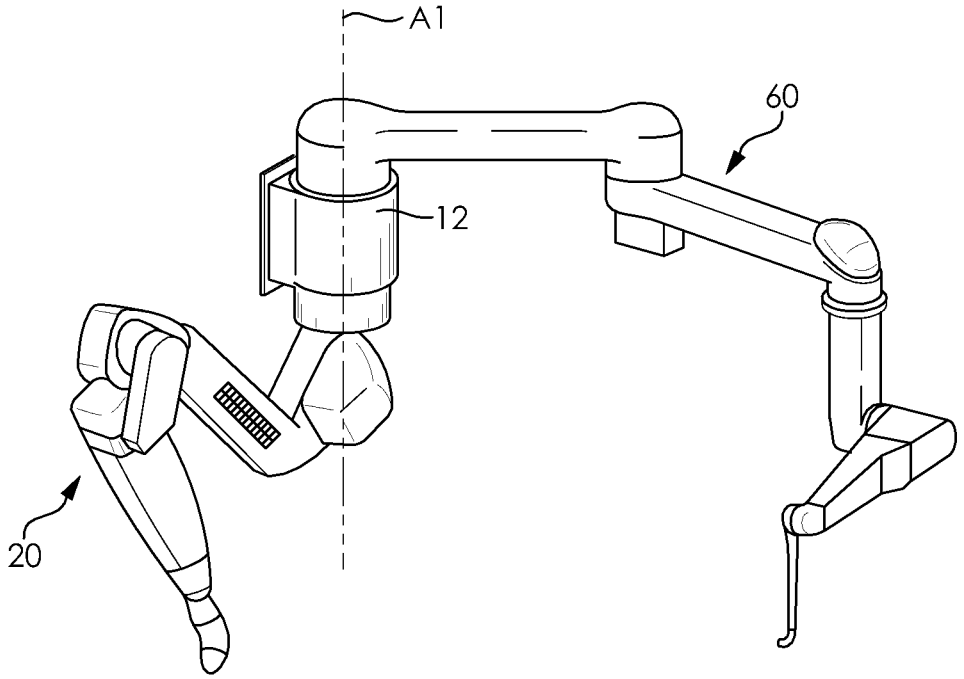
FIG. 10 is a perspective view of a two arm common base robot including the hood-deck opener robot of FIG. 6 and the redundant-axis robot arm of FIG. 1.

FIG. 10 is a perspective view of a two-arm common base robot including the seven-axis paint robot 20 and the five-axis hood-deck opener robot 60 according to the invention. The robot arms 20 and 60 are rotatably mounted on a common base 12 at opposite ends of the common base 12, causing each of the robots 20, 60 to share a common "waist" axis of rotation, which is indicated as the first axis of rotation A1 as shown in FIG. 10. In this configuration, the seven-axis paint robot 20 is invert mounted to a vertically oriented surface such as a wall or the vertical column 28 while the five axis hood-deck opener robot 60 is mounted in an upright position. It should be understood, however, that any combination of the six-axis paint robot 6, the seven-axis paint robot 20, the five-axis door opener robot 50, and the five-axis hood-deck opener robot 60 may be rotatably coupled to the opposing ends of the common base 12, including two of the same type of robot 6, 20, 50, 60 coupled to each end of the common base 12, as desired. Furthermore, it should be understood that the common base 12 may be mounted in any orientation, including a horizontal mounting orientation causing any of the robots 6, 20, 50, 60 sharing the common base 12 to share a horizontal "waist" axis of rotation. In addition, additional robots arms and/or opening devices could be added to the vertical mounting structure. The common base 12 for two robot arms has the advantages of a shared purge for two paint robot arms 6, 20, a compact envelope, and reduced manufacturing cost.

As shown in FIG. 9, each of the hood-deck opener robots 60 is upright mounted on one end of one of the common bases 12 while one of the seven-axis paint robots 20 is invert mounted to a second end of the one of the common bases 12. The common bases 12 are then mounted to one of the columns 28 disposed in the central portion of the paint booth 40. The hook-deck opener robots 60 are mounted to the common base 12 such that each hood-deck opener robot 60 may rotate along a horizontal plane below the vertical beams 29 connecting each pair of the columns 28 disposed on opposite longitudinal sides of the paint booth 40. When the hood-deck opener robot 60 is mounted above the seven-axis paint robot 20 on the common base 12 as shown in FIGS. 9 and 10, the placement of the hood-deck opener robot 60 is optimized to avoid interfering with the seven-axis paint robot arm 20. Also, this placement is optimal for the hood-deck opener robot 60 to share a common work envelope with the seven-axis paint robot 20. Additionally, the redundant axis formed within the hood-deck opener robot 60 may aid the hood-deck opener robot 60 in retracting toward an associated one of the columns 28 when the hood-deck opener robot 60 is not in use, further avoiding interference with the other robots 6, 20, 50 used in the paint booth 40.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An opener robot arm for opening a vehicle body panel, said opener robot arm comprising:

a base attached to a fixed surface;

a first link rotatably coupled at a first end to the base about a first axis of rotation;

a second link rotatably coupled at a first end to a second end of the first link about a second axis of rotation which is parallel to the first axis of rotation;

a third link arranged perpendicular to the second link and rotatably coupled at a first end to a second end of the second link about a third axis of rotation which is parallel to the second axis of rotation;

a fourth link rotatably coupled at a first end to a second end of the third link about a fourth axis of rotation which is perpendicular to the third axis of rotation; and an opener tool rotatably coupled at a first end to a second end of the fourth link about a fifth axis of rotation which is parallel to the fourth axis of rotation.

2. The opener robot arm according to claim 1 wherein the first, second and third axes of rotation are vertical and the fourth and fifth axes of rotation are horizontal.

3. The opener robot arm according to claim 2 wherein the base is attached to a wall or a vertical column of a paint booth.

4. The opener robot arm according to claim 3 further comprising a six-axis or seven-axis paint robot arm coupled to the base.

5. The opener robot arm according to claim 4 wherein the opener robot arm and the paint robot arm share a common purge.

6. A robotic painting system for painting a workpiece comprising:

a base attached to a fixed surface;

a hood/deck opener robot arm including a first link rotatably coupled at a first end to the base about a first axis of rotation, a second link rotatably coupled at a first end to a second end of the first link about a second axis of rotation which is parallel to the first axis of rotation, a third link arranged perpendicular to the second link and rotatably coupled at a first end to a second end of the second link about a third axis of rotation which is parallel to the second axis of rotation, a fourth link rotatably coupled at a first end to a second end of the third link about a fourth axis of rotation which is perpendicular to the third axis of rotation, and an opener tool rotatably coupled at a first end to a second end of the fourth link about a fifth axis of rotation which is parallel to the fourth axis of rotation; and a paint robot arm operating in cooperation with the opener robot arm.

7. The robotic painting system according to claim 6 wherein a first link of the paint robot arm is also coupled to the base.

8. The robotic painting system according to claim 7 wherein the hood/deck opener robot arm and the paint robot arm share a common purge.

9. The robotic painting system according to claim 6 wherein the first link of the hood/deck opener robot arm is located above the base, and a first link of the paint robot arm is located below the base.

10. The robotic painting system according to claim 9 further comprising a door opener robot arm mounted below the paint robot arm.

11. The robotic painting system according to claim 6 wherein the paint robot arm is a six-axis or seven-axis paint robot arm.

12. The robotic painting system according to claim 11 wherein the paint robot arm is a seven-axis paint robot arm configured for painting an interior of a vehicle body after an opening panel of the vehicle body is opened by the hood/deck opener robot arm or a door opener robot arm.

13. The robotic painting system according to claim 6 wherein the base is attached to a wall or a vertical column of a paint booth.

14. The robotic painting system according to claim 13 further comprising additional units of the hood/deck opener robot arm and the paint robot arm mounted at other locations in the paint booth.

15. A robotic painting system for painting a vehicle body having opening panels, comprising:

a plurality of vertical columns positioned on opposite sides of a path of travel of the vehicle body through a painting booth;

a first pair of six-axis or seven-axis paint robot arms attached to a first pair of the columns on opposite sides of the path for painting a first exterior coat on the vehicle body;

two hood/deck opener robot arms each attached to one of four others of the columns, the four others of the columns being positioned two on each side of the path, where each of the hood/deck opener robot arms includes a first link rotatably coupled at a first end to the base about a first axis of rotation, a second link rotatably coupled at a first end to a second end of the first link about a second axis of rotation which is parallel to the first axis of rotation, a third link arranged perpendicular to the second link and rotatably coupled at a first end to a second end of the second link about a third axis of rotation which is parallel to the second axis of rotation, a fourth link rotatably coupled at a first end to a second end of the third link about a fourth axis of rotation which is perpendicular to the third axis of rotation, and an opener tool rotatably coupled at a first end to a second end of the fourth link about a fifth axis of rotation which is parallel to the fourth axis of rotation;

four seven-axis paint robot arms each attached to one of the four others of the columns;

a door opener robot arm mounted below each of the four seven-axis paint robot arms, where the four seven-axis paint robot arms are configured for painting an interior of the vehicle body after the opening panels have been opened by one of the hood/deck opener robot arms or the door opener robot arms; and a second pair of six-axis or seven-axis paint robot arms attached to a second pair of the columns on opposite sides of the path for painting a second exterior coat on the vehicle body, the second pair of the columns being at a distal end of the painting booth from the first pair.

16. The robotic painting system according to claim 15 wherein the first link of each of the two hood/deck opener robot arms is located above a first link of a corresponding one of the seven-axis paint robot arms.

17. The robotic painting system according to claim 15 wherein each one of the two hood/deck opener robot arms and a corresponding one of the seven-axis paint robot arms share a common base and also share a common purge.

18. The robotic painting system according to claim 15 wherein each of the seven-axis paint robot arms includes a redundant axis of rotation positioned between a shoulder axis of rotation and an elbow axis of rotation.

19. The robotic painting system according to claim 18 wherein a waist axis of rotation of the seven-axis paint robot arm at the base and the shoulder axis of rotation are perpendicular and intersect.

20. The robotic painting system according to claim 18 wherein the redundant axis of rotation of the seven-axis paint robot arm is oriented transverse to and intersects both the shoulder axis of rotation and the elbow axis of rotation.

* * * * *